United States Patent [19]

Swift, Jr.

[11] 4,133,147

[45] Jan. 9, 1979

[54] ABRASIVE BRUSHES AND METHODS OF MAKING SAME

[75] Inventor: David J. Swift, Jr., Webster, N.Y.

[73] Assignee: Schlegel Corporation, Rochester, N.Y.

[21] Appl. No.: 823,672

[22] Filed: Aug. 11, 1977

[51] Int. Cl.[2] ..... B24D 13/14; A46B 3/02

[52] U.S. Cl. ..... 51/400; 15/159 A; 51/295; 51/403; 300/21

[58] Field of Search ..... 51/400, 404, 403, 293, 51/295; 15/159 A, 180, 226, DIG. 3; 300/21

[56] References Cited

U.S. PATENT DOCUMENTS

| | | | |
|---|---|---|---|
| 2,294,245 | 8/1942 | Schlegel | 15/226 X |
| 2,335,902 | 12/1943 | Ball | 51/403 |
| 2,366,877 | 1/1945 | Schlegel | 300/21 |
| 2,642,705 | 6/1953 | Jensen | 15/DIG. 3 |
| 3,237,234 | 3/1966 | Tilgner | 15/180 |
| 3,246,356 | 4/1966 | Sorrells | 51/404 X |
| 3,605,347 | 9/1971 | Barry | 51/400 X |
| 3,939,612 | 2/1976 | Peterson | 51/293 |

FOREIGN PATENT DOCUMENTS

| | | | |
|---|---|---|---|
| 255917 | 2/1949 | Switzerland | 15/180 |
| 1457074 | 12/1976 | United Kingdom | 51/400 |

*Primary Examiner*—Nicholas P. Godici
*Attorney, Agent, or Firm*—Cumpston & Shaw

[57] ABSTRACT

An elongate, abrasive strip element is produced by winding an abrasive monofilament, or bundles thereof, back and forth in a zigzag pattern from side to side of the strip, and chain stitching together adjacent transverse sections of the monofilament, or bundles thereof. The resultant strip is easily rolled or coiled about a transverse axis, but resists bending about a longitudinal axis, whereby it can be manipulated readily to form brush faces of various configurations. The warp yarns which are used to produce the chain stitches may be produced on a knitting machine which can be cammed to vary the number of stitches between adjacent transverse strands of the monofilament wefts, thereby selectively to vary the density of the brush faces produced from the strips, and also to vary the configuration of the abrasive strip itself (i.e. to produce it in linear form, circular, truncated-conical, etc.). The linear form of the strip may be severed medially of its edges to form two, identical bristle strips, each of which may be wound in convolute form, for example, and may be embedded at one side (e.g. by molding) in an elastomeric base to form a disc type brush. Other brush configurations are also disclosed.

7 Claims, 11 Drawing Figures

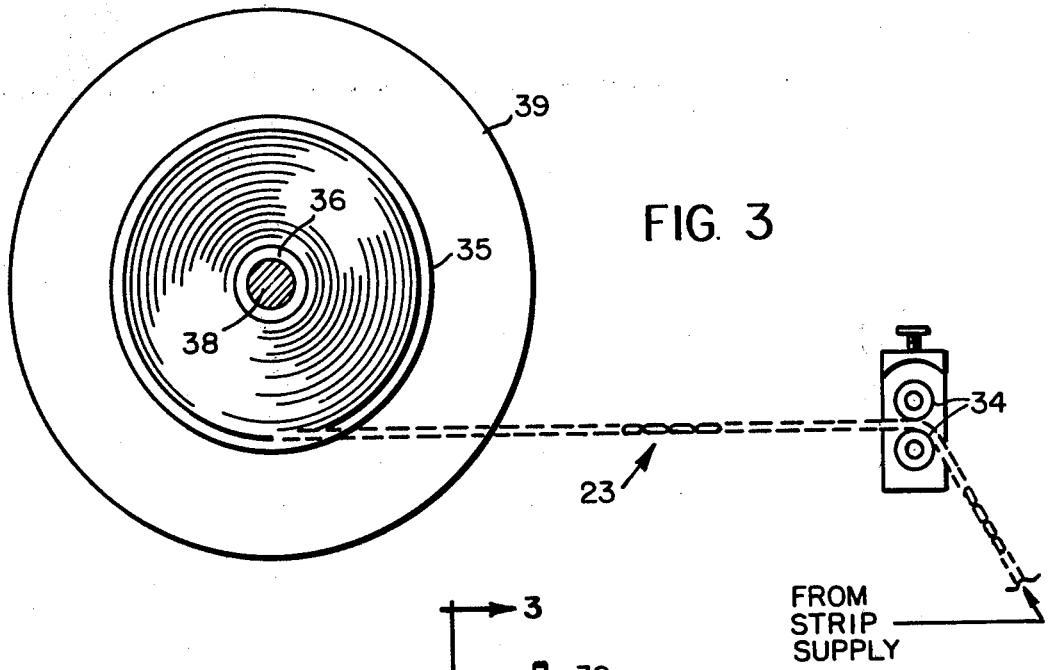
FIG. 3
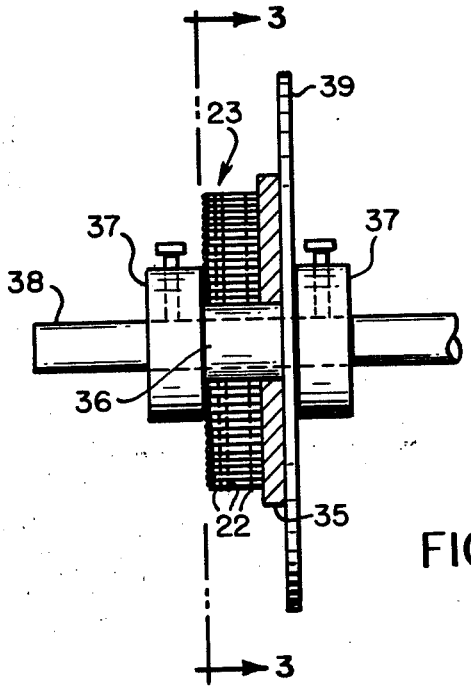
FIG. 4
FIG. 5
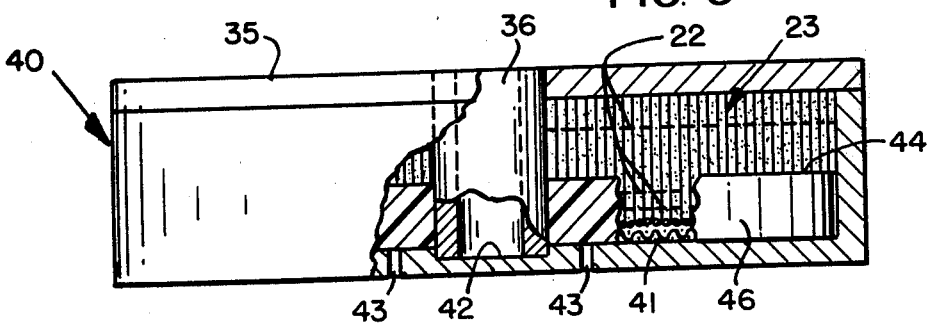

FIG. 6
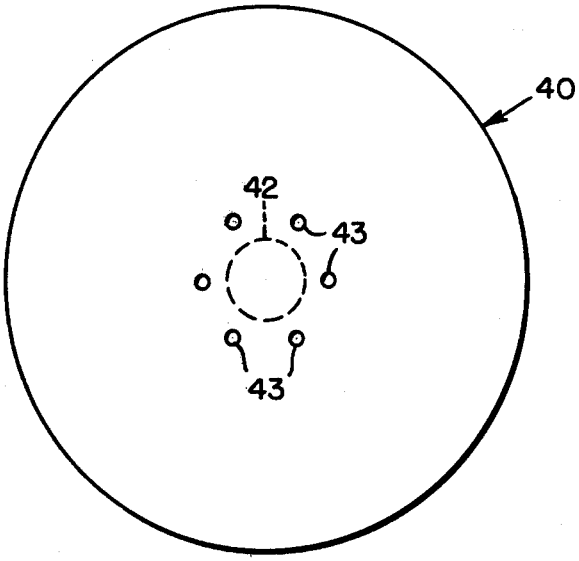
FIG. 7
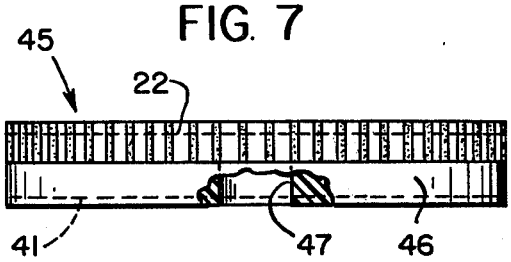
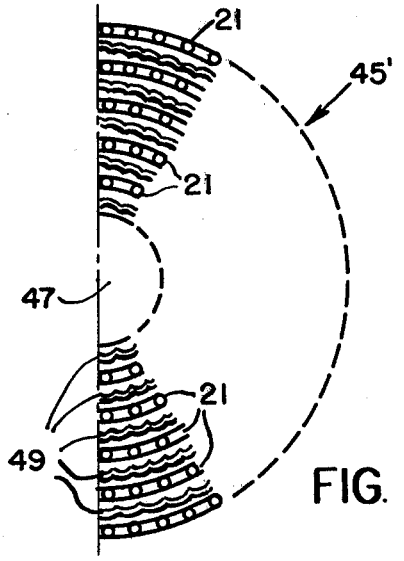
FIG. 8
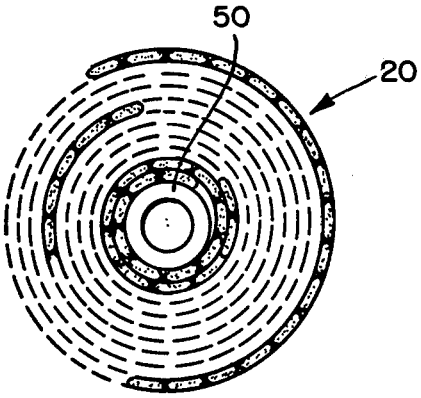
FIG. 9
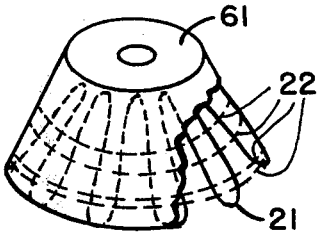
FIG. 10
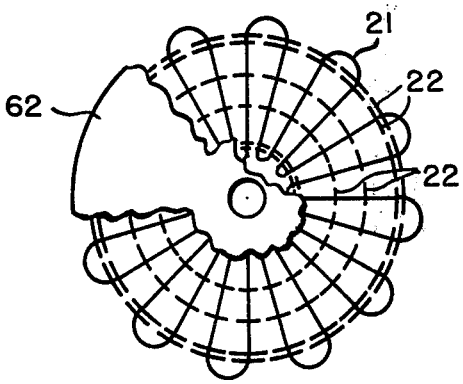
FIG. 11

ABRASIVE BRUSHES AND METHODS OF MAKING SAME

This invention relates to brushes, and more particularly improved abrasive brushes and the methods of manufacturing such brushes.

There has long existed a need for a durable, safe and inexpensive abrasive brush element that would be suitable for use on a multitude of different surfaces or materials, and which could be designed to produce any one of a plurality of different finishes. Such uses include metal deburring, finishing, roughing, material removal, polishing, cleaning and the like. More specifically, it is desirable that such brushes be suitable for use on both regular and irregular surfaces, and on materials falling in a range of from very hard to very soft. Also it is desirable that the brushes be suitable for applications in which the brush is held stationary and the work itself is moved, or alternatively, for applications in which the brush is reciprocated linearly, or is rotated or moved in an orbital fashion at high speeds.

It has been discovered that particularly desirable abrasive brushes can be produced by employing an abrasive monofilament material, such as for example, abrasive nylon monofilaments of the type sold by Nypel Incorporated under the trademark "Nybrad", or by E. I. duPont de Nemours & Co., Inc. under the trademark "Tynex". Generally these abrasive nylon monofilaments have encapsulated therein either aluminum oxide or silicon carbide grit particles, which normally are evenly distributed throughout the monofilament. These abrasive filaments, by their very nature, pose many difficult problems in utilizing the filaments in conjunction with conventional brush-making apparatus. For example, the technique of trimming finished brushes, which incorporate this type of material, is time-consuming and expensive in view of the rapid wear of the cutting edges of the trimming tool.

Moreover, this material, along with many other synthetic filaments, does not hold or bind well in a substrate when mechanically held in place with staples, wire and the like. For example, rotary brushes of the type which utilize two concentric rings having relative diameters such that the rings exert sufficient pressure on the brush fibers to hold them in the brush body, as shown for example in U.S. Pat. No. 2,288,337, often fail in use when abrasive bristles are employed, because the bristle material moves circumferentially of the rings, thus abraiding the rings and concentrating the bristles in localized circumferential zones, where they cause brush imbalance. This further produces uneven work on the surface that is being abraided, and also produces undesirable vibrations in the brush during use. Also, brushes made with fibers which are mechanically tufted into either a rigid or flexible backing, generally have the disadvantage that the fibers work loose during use, and cause the same uneven work surface and imbalance that occurs in the case of the above-noted rotary brushes.

The abrasive nature of monofilaments of the type described also make them impractical for use in channel brush methods of manufacture, wherein short lengths of bristle are laid crosswise to the channel with a wire or similar retainer laid across the bristles in line with the channel, after which the channel is roll formed into a "U" shape around the bristles and retainer. Efforts to practice this channel brush method in connection with the abrasive monofilament bristles have proved very unsatisfactory because the abrasive bristles prematurely wear the mechanical sorting and feeding devices which are used in the process; and the brush material moves laterally in the channel and tends to concentrate in localized areas under load, thereby again causing uneven work surfaces and imbalance in the brush. Additionally, bristles tend to work loose from the retainer much in the same manner as in the case of the tufted type of brush referred to above.

There is still another prior art method which has been attempted. A plurality of the abrasive monofilament bristles or tufts are arranged evenly across a supporting surface, each fiber or tuft being separate from the others, and being individually aligned by orientation at right angles or some other predetermined angle to the plane of the support surface. The fibers are then encapsulated at their inner ends in a resinous backing, that can be modified to enable it to be wrapped onto a cylindrical cone, or to be formed into a belt, or to be cut into a variety of flat or disc-type shapes. The disadvantages of these types of brushes, however, is that they are limited as to the speed at which they can be rotated without causing undesirable failure or pull-out of the individual fibers from the resinous backing material.

It is an object of this invention, therefore, to provide an improved method of anchoring abrasive brush bristles in a backing material of either the flexible or rigid variety, so that the bristles will remain fixed in the backing even when the brushes are operated at high speeds and under difficult load conditions.

To this end it is an object also of this invention to provide a novel bristle element, which is produced in strip form from one or more abrasive nylon monofilaments, and which is suitable for use in manufacturing any one of a variety of abrasive brushes having different configurations.

Another object of this invention is to provide an improved brush of the type described which is manufactured from abrasive monofilament elements, and which is relatively simple and inexpensive to manufacture as compared to prior such brushes.

A further object of this invention is to provide an abrasive brush which has improved means for anchoring the brush tufts or bristles to either a flexible or rigid backing.

Another object of this invention is to provide an improved system for anchoring abrasive brush bristles in backings of various configurations, and particularly in connection with brushes of the type which require a balanced construction, and which are adapted for mounting conveniently upon a power driven core or mandrel for rotation at relatively high speeds.

Still another object of this invention is to provide an improved abrasive brush having a flexible supporting pad or disc, and the bristles which are adapted to conform to, and to finish either regular or irregular surfaces, efficiently and with a minimum of labor.

A further object of this invention is to provide an improved abrasive brush of the type described which is produced from abrasive strands or monofilaments produced from a predetermined blend of similar or dissimilar fibers, including both abrasive and non-abrasive, and in a multitude of different geometric arrays, depending upon the particular application for which the brushes are intended, and the particular surfaces that are to be brushed.

Still another object of this invention is to provide an improved abrasive brush which functions during use simultaneously to abraid the surface that is being brushed, and also to coat the surface with a thin, protective film of plastic material.

Other objects of the invention will be apparent hereinafter from the specification and from the recital of the appended claims, particularly when read in conjunction with the accompanying drawings.

FIG. 3 is a sectional view taken along the line 3—3 in FIG. 4 and illustrating diagrammatically part of the apparatus and one of the method steps employed in producing a disc type brush from a convolutely wound bristle strip of the type shown in FIG. 1;

FIG. 4 is a fragmentary side elevational view of the apparatus shown in FIG. 3;

FIG. 5 is an enlarged elevational view of the mold which is employed to apply an elastomeric base to the convolutely wound bristle strip shown in FIGS. 3 and 4;

FIG. 6 is a bottom plan view of the mold shown in FIG. 5;

FIG. 7 is an elevational view of the finished disc brush, portions thereof being broken away for purposes of illustration;

FIG. 8 is a fragmentary plan view of a modification of this disc brush;

FIG. 9 is a diagrammatic plan view generally similar to FIG. 4, and illustrating still another form of abrasive brush made according to this invention;

FIG. 10 is a perspective view of a truncated conical brush which may be made from a bristle strip produced in accordance with this invention; and FIG. 11 is a perspective view of still another type of abrasive brush which can be made from the novel bristle strips disclosed herein.

Figure 1:
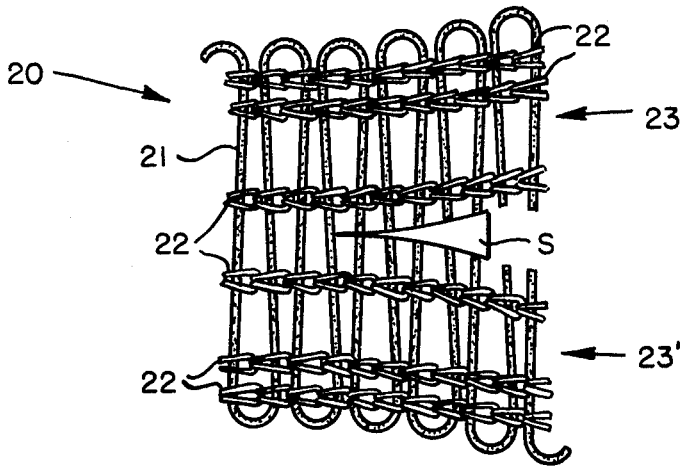
FIG. 1 is a fragmentary plan view of a typical bristle element produced according to this invention in strip form from an abrasive monofilament, and illustrating diagrammatically how this strip may be severed medially of its edges to form two identical bristle strips suitable for use in making abrasive brushes according to this invention.
Figure 2:
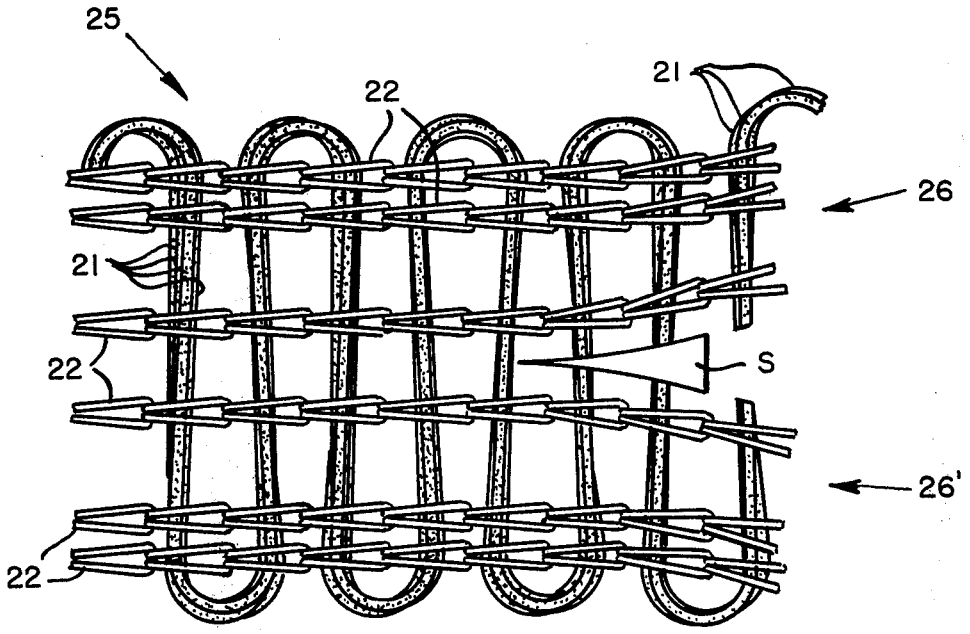
FIG. 2 is a fragmentary plan view generally similar to FIG. 1, but illustrating a modified bristle element produced in strip form from a plurality or bundle of abrasive monofilaments.

Referring now to the drawings by numerals of reference, and first to FIGS. 1 and 2, 20 denotes generally an abrasive bristle element or strip, which can be used in manufacturing any one of a variety of different brushes made in accordance with this invention. This element comprises a single abrasive monofilament strand or bristle 21, which is wound back and forth transversely along the length of strip 20 in the form of a continuous weft, adjacent portions of which are bound together in known manner by a plurality of chain stitch warp yarns 22.

A number of warp strands 22 may be employed to hold adjacent portions of the weft filament 21 in place. In the embodiment illustrated in FIG. 1, two such chain stitch chain warp yarns 22 are knitted along each longitudinal edge of strip 20 to function as so-called anchor warps which secure together adjacent ends of the transverse portions of filament 21 along opposite sides, respectively of the strip. Two additional stitch warp yarns 22 are employed in spaced, parallel relation adjacent the center of the strip 20 to retain adjacent mid-portions of the monofilament 21 in place. However, it will be understood that the number and types of warp yarns selected will depend upon the desired strength of the yarns, backing absorption, backing bondability, and the like. Yarns such as cottons, wool, rayon, polypropylene, polyester, nylon or blends thereof are typical for these warp yarn constructions. As noted above, the continuous monofilament 21 (the weft) may comprise an abrasive nylon monofilament of the type sold under the trademarks "Nybrad", "Tynex", or the like.

The width of strip 20 may vary depending upon the desired trim height of the resulting brush unit. For example, strip 20 is normally designed to be twice as wide as the desired trim or finished height of the bristles on the brushes that are to be made from the strip. It is usually severed medially of its longitudinal side edges in a conventional manner by a slitter S, thus dividing strip 20 into two separate brush strips 23 and 23', which are of equal heights. The respective strips 23 and 23' are thereafter incorporated into brush bases or substrates as noted hereinafter.

The advantage of employing bristle strips of the type denoted at 20 is that the abrasive monofilament 21 can be produced in a flexible, although somewhat rigid form, so that once the monofilament weft has been bent back and forth into its zigzag configuration, it tends to remain in this position so that the strain on the chain stitch warps 22 is minimized. Moreover, despite this relative firmness of the monofilament 21, it nevertheless can be arranged on beams or creels in the usual manner so that it can be drawn into a knitting device which forms the warp yarns 22 into the chain stitches as shown in FIG. 1. The two chain stitch yarns 22 located adjacent the center of strip 20 are utilized to hold the transverse filament sections straight during the slitting process effected by the slitter S, and also to maintain bristle or filament integrity during subsequent brush construction steps.

In FIG. 2, wherein like numerals are employed to denote elements similar to those employed in the embodiment shown in FIG. 1, 25 denotes a modified bristle strip which is produced from a plurality of abrasive monofilaments 21, which are fed in the form of a continuous bundle into a knitting machine (not illustrated), which stitches together the adjacent portions of the zigzag bundle of filaments along the stitch lines 22 in a manner similar to that in which the single monofilament 21 is stitched in FIG. 1. As in the case of the first embodiment, two rows of chain stitches are employed along each side of strip 25 to anchor or hold in place adjacent ends of the transversely extending portions of the bundle of monofilaments 21; while two, spaced, generally parallel chain stitches 22 are employed substantially medially of the sides of strip 25 for purposes similar to that described in connection with the corresponding yarns in the first embodiment. Also as in the case of strip 20, the bristle strip 25 is adapted to be severed longitudinally and medially of its side edges by a slitter S to divide the strip into two equal brush strips or elements 26 and 26'. In this embodiment, of course, a plurality of monofilament bristles are thus produced within each surrounding chain stitch, as compared to the single monofilament bristle which is produced within each chain stitch of the embodiment shown in FIG. 1.

One major advantage of producing strips of the type denoted at 20 and 25 is that the spacing of adjacent, transverse portions of the bristle filaments or bundles can be arranged to be arithmetically repeatable by selecting the type of chain stitch construction that will be produced by the associated knitting machine. For example, by properly camming the needle bar on the associated knitting device, the machine will either place single filament sections side by side to form a solid array of bristles in a brush face, or, alternatively, it will vary the number of stitches between each transverse section of a filament (or section of a filament bundle) to create a space between adjacent bristles or bundles thereof. In this manner it is possible to space the filament bristles in such way as to produce almost any variation of brush face density desired.

Although in the above discussion it has been suggested that the strips 20 or 25 be severed medially of their longitudinal side edges, it would be possible, of course, to slit the strips off center, thereby to produce two brush strips of dissimilar height.

One method of producing a disc-shaped brush from a brush strip of the type denoted, for example, at 23 in FIG. 1, is illustrated diagrammatically in FIGS. 3 to 6, wherein 36 denotes a tubular hub or core around which the strip 23 is adapted to be wound spirally as noted hereinafter. The hub 36, which may be constructed of metal or molded plastic material, serves both as a form around which the abrasive strip 23 is wound, and also as a core for anchoring the wound strip in a mold 40 (FIG. 5) that is used for applying an elastomeric or similar base to the strip 23 as noted hereinafter.

In practice the hub 36 is secured coaxially on a spindle or shaft 38 by a pair of clamps 37, with one end of the hub 36 (the right end in FIG. 4) extending coaxially through a bore in a circular backing plate 35, which is also secured on shaft 38 against an enlarged-diameter collar 39. One end of the strip 23 is attached to the hub 36 with the severed ends of filament 21 facing plate 35. The shaft 38 is then rotated together with the backing plate 35 and collar 39, so that the strip 23 is spirally wound from a supply thereof around the hub 36, while being maintained under suitable tension by means of tension rolls 34 (FIG. 3) of any conventional design.

Winding of the strip 23 is continued until a brush face is built up to the desired diameter against the face of the plate 35. During this winding adjacent portions of the convolutions of the strip 23 are secured in place by a flexible adhesive, which is applied along the anchoring edge of the strip 23 adjacent the anchoring or dual warp strands 22. This adhesive is applied as the strip 23 is wound onto the hub 36 as shown in FIGS. 3 and 4.

Thereafter a disc-type brush is formed by removing the wound strip 23, hub 36 and backing plate 35 from shaft 38, and placing this assembly, with the dual stitched warp edge or anchor edge of the strip facing downwardly, into either an epoxy or metal mold 40 (FIG. 5). The spiral wound strip 23 rests upon a reinforcing layer 41 of fiber glass screen mesh or similar material, which has been precut and placed in the bottom of the mold 40 prior to the insertion of the spiral wound strip. The screen acts as a reinforcing agent for the brush backing when encapsulated into the base of the completed brush. The hub 36 centers the wound brush element 23 in the mold by precisely fitting into a circular notch or recess 42 formed in the base of the mold. At this stage the base plate 35 acts as a mold cover and provides a level brush face when clamped onto the top of the mold 40 by conventional clamps, not illustrated.

The mold 40, with the appropriate brush element in place, is now placed on the face plate (not illustrated) of a conventional elastomeric molding compound dispenser. The dispenser is actuated to force a predetermined amount of molding compound into the mold through precisely arranged orifices 43 (FIG. 5) located in the mold base. The molding compound, which is in a liquid state, rises in the mold 40 to a predetermined level (for example as denoted by a broken line at 44 in FIG. 5), at which point it completely encapsulates each bristle at its anchored end to a level above the dual warp or anchor stitches 22.

When the elastomeric material, such as urethane or the like, has cured, the unique anchor of this invention has been accomplished, and the completed brush 45 (FIG. 7) may be removed from the mold. The now-cured elastomeric material forms a relatively thin, firm, flexible base 46 having an axial bore 47 for attaching the brush to a mandrel or other motor-driven mount for rotating the brush 45 in contact with the work.

The tough urethane or similar elastomeric backing 46 encapsulates the bristles of the brush face at their bases to a predetermined height. This action provides a mechanical bond to all of the construction elements. The warp materials in the dual chain stitches absorb a percentage of the backing material thereby further increasing the bonding effect of the process. Since each bristle filament is interlocked by the dual chain stitches to all of the other bristle filaments in the brush, the brush face is further strengthened by both of the above actions. This combination of actions produces a brush face that is particularly durable for applications requiring rotation of brush 45 at high speeds, when it is attached to a mandrel. This anchor also allows 100% flexibility of the individual bristles within their individual range of tensile strength and bend recovery. The brush made in accordance with these teachings will retain more bristles when applied to sharp and uneven edges and surfaces, welded studs and similar protruding objects. The anchoring section or base 46 for the brush is thin in relation to the overall thickness of the brush, so that the brush is relatively flexible in directions transverse to the anchoring section enabling it to conform readily to uneven surfaces during use.

As previously noted, the spacing of the bristles within the brush face can be predetermined and controlled in several ways. First, the warp stitch yarns 22 can be arranged with or without spacer yarns that can locate the bristle filaments 21 (FIG. 1) or bristle bundles (FIG. 2) in a precise arrangement either immediately adjacent to each other, or a definite distance apart. The center warp stitches, which are located at or near the face of the completed brush, can be altered in size and location independent of the anchor warps and spacer yarns to control the orientation of the bristle from 90% perpendicular to the base to an angle of several degrees from the perpendicular depending on the application. Secondly, bristle orientation may be achieved by controlling the warp yarn spacing. This is called a controlled gap knit wherein a controlled spacing can be maintained between bundles or bristles.

Still another means of orienting the brush bristles is shown in FIG. 8, wherein flexible spacers 49 are located in between adjacent convolutions of bristle elements in a modified disc type brush 45'. The spacers 49 may be fed between adjacent convolutions as the brush element is being spirally wound onto a core as shown for example in FIGS. 3 and 4. Moreover, similar spacers, if desired, may be provided to control lateral spacing of bristles in a linear brush unit.

It is also possible to construct a rotary brush by taking the element 20 shown in FIG. 1 and wrapping it concentrically upon itself as shown in FIG. 9 around a hub 50 to the desired diameter. As the strip 20 is wound concentrically around the hub 50, an adhesive material is added between adjacent convolutions to contain the wound strip in the form of a grinding wheel. The center line warps 22 remote from the side edges of strip 20 are removed as the element is wound, thereby exposing as much abrasive surface as possible. The completed brush may be removed from the hub 50 and secured to a drive shaft for use as a grind stone.

The encapsulation of basically any construction of abrasive filaments as described previously can be accomplished to broaden the use of the invention to soft or hard abrasive or finishing wheels. FIGS. 10 and 11, for example, illustrate diagrammatically various loop arrangements of filaments which are encapsulated in a hard or soft elastomeric compound. The wheel in FIG. 10 comprises a modified strip 20 or 25 which is wound about a core that has an axis extending transverse to the length of the strip, thereby to form a truncated conical bristle element which is embedded in a truncated conical body 61 of elastomeric material. In this embodiment the anchoring stitch warps 22 adjacent one side of the modified strip 20 or 25 may be made to allow the adjacent sections of the monofilaments 21 to be spread further apart along one edge of the strip, thus to allow the wound strip to assume the truncated conical configuration.

In the embodiment shown in FIG. 11 the strip 20 or 25 is modified slightly further to space portions of the monofilaments 21 substantially further apart along one side of the strip than at the other, whereby one or more such strips may be formed coaxially about a core so that the transverse sections of the monofilaments in each strip flare radially outwardly as spokes from the hub. When one or more such strips are embedded in elastomeric material 62, the wheel-shaped brush of FIG. 11 is produced.

One of the most important advantages of abrasive brushes of the type described is that the firmly anchored abrasive bristles not only abraid or polish a work surface, when in use, but also simultaneously deposit a thin organic film of nylon on the surface as the nylon matrix for the abrasive particles wears away during use. This not only helps to prevent undesirable oxidation of metallic surfaces, but also provides a longer lasting bright finish on aluminum, magnesium or steel panels, when used to polish same, and a better bond for organic paints or finishes applied to the panels.

In all of the previously described brushes, the minimum of anchor actions are always three: the mechanical linkage of the individual groups of filaments 21 (or bundles thereof) and the warp stitch yarns 22 throughout the construction; the mechanical interaction of the elastomeric base material and the groups or individual filaments 21; and the chemical bond interaction or fusion of the base material with either or both the anchor warp yarns 22 and the filaments 21 themselves.

Although not disclosed in detail herein, it will be apparent that other types of abrasive brushes may be made from bristle strips of the type shown in FIGS. 1 and 2. For example, one or more bristle strips 23 could be used to form linear (rectangular) brushes by passing a strip 23 through the cross head of an extrusion die, which feeds a plastic material to the base or anchoring edge of the strip as it passes through the die and the associated shaping shoes. The plastic base produced by this process may have any one of a plurality of different cross sectional configurations, and may be used to mount the bristle strip in a correspondingly shaped groove or recess in a brush body or the like.

The herein described constructions offer disc, linear or rotary brushes with a securely anchored base construction and a uniform finishing periphery portion, which has been found effectively to resist bristle loss, unraveling, and disintegration to which prior devices of this sort have been subject. While applicant's improved brushes accomplish the objects of the invention, and while only certain preferred embodiments and details of structure and methods of construction have been described in detail herein, it is understood that this application is intended to cover any other modifications that may fall within the scope of one skilled in the art, or the appended claims.

Having thus described my invention, what I claim is:

1. A method of making an abrasive brush from synthetic monofilament elements of the type containing an abrasive grit, comprising folding successive portions of an abrasive monofilament element back and forth transversely of its axis in a zigzag pattern, stitching said successive transverse portions of the element together with at least a pair of warp yarns to produce an abrasive strip in which said warp yarns extend longitudinally of the strip adjacent opposite sides thereof, slitting said strip along a line extending longitudinally of the strip between said warps to form therefrom two separate brush strips, forming one of said strips into a predetermined shape corresponding to the shape of the desired brush face, and embedding at least one longitudinal side edge of the formed strip, and at least one of said pair of warp yarns, in an elastomeric material which forms an anchoring matrix for the embedded portion of said strip, whereby each transverse portion of said element is secured to every other transverse portion both by said matrix material and by the warp yarn embedded therein, said forming step including winding said one brush strip spirally about a cylindrical hub with transverse portions of said element extending generally parallel to the axis of said hub, and with the severed ends of said one strip facing a plate removably mounted on one end of said hub, and inserting said hub and said wound brush strip into a mold with said plate positioned over the top of the mold to close the upper end thereof and to maintain said severed ends of said one strip in generally coplanar relation, and molding said elastomeric material to the edge of the strip remote from said plate.

2. A method as defined in claim 1 including inserting a flexible spacer element between adjacent convolutions of said one brush strip during the winding thereof on said hub.

3. A method as defined in claim 1, including applying an adhesive material to said remote edge of said one brush strip during the winding thereof on said hub.

4. A method as defined in claim 1, including placing a flat, disc-shaped screen member in the bottom of said mold before inserting said hub and said wound brush strip in the mold, whereby said screen member is secured by said elastomeric material to the bottom of said wound brush strip during the molding operation.

5. An abrasive member comprising an elastomeric support having therethrough an axial bore and a plane surface on at least one end thereof, a plurality of abrasive loops secured in said support, each of said loops being made from at least one synthetic monofilament element containing an abrasive grit distributed substantially uniformly throughout the element, and having at least one generally "U" shaped portion the closed end of which is embedded in said support, said closed ends lying in a common plane adjacent to and generally parallel with said plane surface, at least one continuous warp yarn embedded in said support and stitched to each leg of each of the embedded "U" shaped portions of said loops, said warp yarn and the loops interconnected thereby being arranged in a spiral path around said bore, said elastomeric support material being bonded directly both to said warp yarn and to said embedded portions of said loops to provide a firm anchor for the latter, said support having plane surfaces thereon at opposite ends, respectively, of said bore, and said loops comprising at least one monofilament element adjacent portions of which are wound back and forth in a zigzag pattern transversely of said spiral path and between said plane surfaces on said support whereby "U" shaped portions of said loops are located adjacent each of said plane surfaces on said support.

6. An abrasive member comprising an elastomeric support having therethrough an axial bore and plane surface on at least one end thereof, a plurality of abrasive loops secured in said support, each of said loops being made from at least one synthetic monofilament element containing an abrasive grit distributed substantially uniformly throughout the element, and having at least one generally "U" shaped portion the closed end of which is embedded in said support, said closed ends lying in a common plane adjacent to and generally parallel with said plane surface, at least one continuous warp yarn embedded in said support and stitched to each leg of each of the embedded "U" shaped portions of said loops, said warp yarn and the loops interconnected thereby being arranged in a spiral path around said said elastomeric support material being bonded directly both to said warp yarn and to said embedded portions of said loops to provide a firm anchor for the latter, the legs of said "U" shaped portions of said loops being spaced further apart from each other adjacent one end of said support than the other, and said brush being generally truncated conical in configuration.

7. An abrasive member comprising an elastomeric support having therethrough an axial bore and a plane surface on at least one end thereof, a plurality of abrasive loops secured in said support, each of said loops being made from at least one synthetic monofilament element containing an abrasive grit distributed substantially uniformly throughout the element, and having at least one generally "U" shaped portion the closed end of which is embedded in said support, said closed ends lying in a common plane adjacent to and generally parallel with said plane surface, at least one continuous warp yarn embedded in said support and stitched to each leg of each of the embedded "U" shaped portions of said loops, said warp yarn and the loops interconnected thereby being arranged in a spiral path around said bore, said elastomeric support material being bonded directly both to said warp yarn and to said embedded portions of said loops to provide a firm anchor for the latter, each of said loops comprising a separate "U" shaped, abrasive, monofilament element the two legs of which have free ends which project substantially equi-distantly from said common plane in which said closed ends are embedded, and parallel to the axis of said bore in said support, a thin flexible layer of material extending between and separating the convolutions formed by the spirally arranged loops and warps yarns, and a disc-shaped reinforcing screen embedded in said support beneath said closed ends of said loops.

* * * * *

UNITED STATES PATENT OFFICE

CERTIFICATE OF CORRECTION

PATENT NO. : 4,133,147

DATED : January 9, 1979

INVENTOR(S) : David J. Swift, Jr.

It is certified that error appears in the above-identified patent and that said Letters Patent are hereby corrected as shown below:

Column 10, line 2, after "said" insert --bore,--.

Signed and Sealed this

*Twenty-third* Day of *September 1980*

[SEAL]

*Attest:*

SIDNEY A. DIAMOND

*Attesting Officer*

*Commissioner of Patents and Trademarks*